US006588129B1

(12) United States Patent
Holland

(10) Patent No.: US 6,588,129 B1
(45) Date of Patent: Jul. 8, 2003

(54) GREETING CARD

(76) Inventor: Josie Holland, 1765 Plumas St., Reno, NV (US) 89509

( * ) Notice: Subject to any disclaimer, the term of this patent is extended or adjusted under 35 U.S.C. 154(b) by 353 days.

(21) Appl. No.: 09/248,153

(22) Filed: Feb. 10, 1999

(51) Int. Cl.[7] ..... G09F 1/00
(52) U.S. Cl. ..... 40/124.11
(58) Field of Search ..... 40/124.11

(56) References Cited

U.S. PATENT DOCUMENTS 5,261,703 A * 11/1993 Lenkoff ..... 40/124.11 X
5,370,421 A * 12/1994 Kaiser ..... 40/124.11 X

* cited by examiner

*Primary Examiner*—J. J. Swann
*Assistant Examiner*—Andrea Chop
(74) *Attorney, Agent, or Firm*—Thompson E. Fehr

(57) ABSTRACT

A greeting card having a first section containing a pre-colored drawing or photograph to provide whatever guidance a person desires for placing colors in segments of a line drawing which corresponds at least to a portion of the pre-colored drawing or photograph and which is contained on a colorable second section of the greeting card. Preferably, the first section of the greeting card will also contain a first textual message, preferably a greeting; and the second section will contain a second textual message, preferably encouragement to color the line drawing.

20 Claims, 1 Drawing Sheet

GREETING CARD

BACKGROUND OF THE INVENTION

1. Field of the Invention

This invention relates to greeting cards, especially greeting cards that have a portion into which a person can enter the colors such person desires.

2. Description of the Related Art

U.S. Pat. No. 5,370,421 describes a greeting card having line drawings which can have colors entered between the lines with multi-colored writing utensils.

Reference is made to the line drawings as being"drawings, illustrations, or cartoons." In fact, lines 34 through 40 in column 1 of U.S. Pat. No. 5,370,421 state, "What makes this invention unique and original are the drawings, illustrations, or cartoons which are presented to encourage the person having this invention to color the drawings, illustrations or cartoons thus making the Greeting Card colorful, and add his/her personal touch to it."

Nowhere does U.S. Pat. No. 5,370,421 indicate that the greeting card would contain a pre-colored drawing, at least a portion of which pre-colored drawing corresponds to the entire line drawing within which a person could enter colors of such person's choosing.

SUMMARY OF THE INVENTION

The present invention includes a pre-colored drawing or photograph and a line drawing corresponding to at least a portion, and preferably all, of the pre-colored drawing.

A person may then utilize the pre-colored drawing or photograph as a guide to what colors should be inserted in which locations of the line drawing if the person desires to copy the pre-colored drawing or photograph. If, however, a person does not desire to utilize the same color scheme as exists in the pre-colored drawing or photograph, such person may enter any desired color in any desired location. But the pre-colored drawing or photograph is available to give whatever guidance a person desires to utilize.

DESCRIPTION OF THE PREFERRED EMBODIMENT

Figure 1:
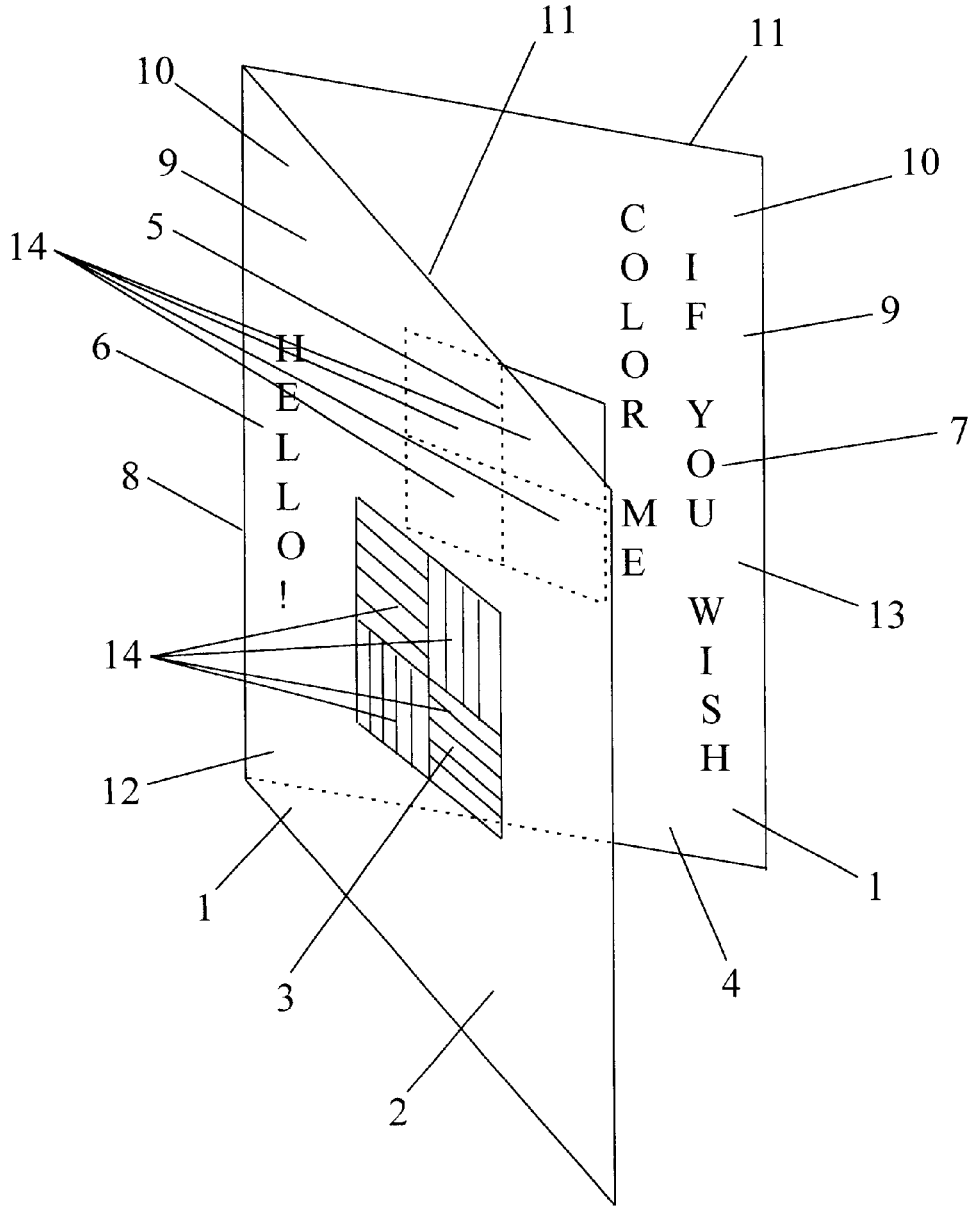
FIG. 1 illustrates the greeting card of the present invention.

The greeting card of the present invention has at least two surfaces 1. A first surface 2 contains a pre-colored drawing or photograph 3, and a second surface 4 contains a line drawing 5 corresponding to at least a portion, and preferably all, of the pre-colored drawing or photograph 3. The greeting card is composed of any material well known in the art which can be colored by any coloring implement well known in the art. Furthermore, either or both surfaces 1 may contain a textual message, such as a greeting 6 or encouragement 7 to place colors in the line drawing 5.

Preferably, the greeting card is composed of paper and has at least one fold line 8 dividing the card into at least two sections 9, each of such sections 9 having a front surface 10 and a rear surface 11.

Also preferably, the front surface 10 of the first section 12 contains a pre-colored drawing or photograph 3 (The presence of colors in FIG. 1 are indicated by parallel lines; for the illustration it does not matter what colors the lines represent.); and the front surface 10 of the second section 13 contains a line drawing 5 corresponding to the pre-colored drawing or photograph 3. It is further preferred that the first section 12 will fold in front of the second section 13.

And even further preferred is the presence of a textual greeting 6 on the front surface 10 of the first section 12 and textual encouragement 7 to color the line drawing 5 on the front surface 10 of the second section 13.

The pre-colored drawing or photograph 3 can serve to provide only so much guidance as to which colors to locate where in the segments 14 of the line drawing 5 as a person coloring the card desires to utilize. The younger the user, the more guidance the user is likely to need.

I claim:

1. A greeting card, which comprises:

a first surface containing a pre-colored drawing or photograph; and a second surface composed of colorable material and containing a line drawing corresponding to at least a portion of the pre-colored drawing and having segments into which colors can be placed.

2. The greeting card as recited in claim 1, further comprising:

a first textual message on said first surface.

3. The greeting card as recited in claim 2, wherein:

said first textual message is a textual greeting.

4. The greeting card as recited in claim 3, further comprising:

textual encouragement to color the line drawing, said textual encouragement being located on said second surface.

5. The greeting card as recited in claim 2, further comprising:

a second textual message on said second surface.

6. A greeting card, which comprises:

a first section having a front surface containing a pre-colored drawing or photograph; and a second section composed of colorable material and having a front surface containing a line drawing corresponding to at least a portion of the pre-colored drawing and having segments into which colors can be placed, said second section being so attached to said first section that said first section can be folded over said second section.

7. The greeting card as recited in claim 6, further comprising:

a textual message on the front surface of said first section.

8. The greeting card as recited in claim 7, wherein:

said first textual message is a textual greeting.

9. The greeting card as recited in claim 8, further comprising:

textual encouragement to color the line drawing, said textual encouragement being located on said second surface.

10. The greeting card as recited in claim 7, further comprising:

a textual message on the front surface of said second section.

11. A greeting card, which comprises:

a first surface containing a pre-colored drawing or photograph; and a second surface composed of colorable material and containing a line drawing corresponding to the pre-colored drawing and having segments into which colors can be placed.

12. The greeting card as recited in claim 11, further comprising:

a first textual message on said first surface.

13. The greeting card as recited in claim 12, wherein:

said first textual message is a textual greeting.

14. The greeting card as recited in claim 13, further comprising:

textual encouragement to color the line drawing, said textual encouragement being located on said second surface.

15. The greeting card as recited in claim 12, further comprising:

a second textual message on said second surface.

16. A greeting card, which comprises:

a first section having a front surface containing a pre-colored drawing or photograph; and a second section composed of colorable material and having a front surface containing a line drawing corresponding to the pre-colored drawing and having segments into which colors can be placed, said second section being so attached to said first section that said first section can be folded over said second section.

17. The greeting card as recited in claim 16, further comprising:

a textual greeting on the front surface of said first section.

18. The greeting card as recited in claim 17, wherein:

said first textual message is a textual greeting.

19. The greeting card as recited in claim 18, further comprising:

textual encouragement to color the line drawing, said textual encouragement being located on the front surface of said second section.

20. The greeting card as recited in claim 17, further comprising:

a textual message on the front surface of said second section.

* * * * *